US007677016B2

(12) United States Patent
Trebbi

(10) Patent No.: US 7,677,016 B2
(45) Date of Patent: Mar. 16, 2010

(54) CAPSULE FILLING MACHINE AND METHOD FOR PRODUCING HARD GELATIN CAPSULES

(75) Inventor: Roberto Trebbi, Castenaso (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 498 days.

(21) Appl. No.: 10/568,506

(22) PCT Filed: May 9, 2005

(86) PCT No.: PCT/IB2005/001398

§ 371 (c)(1),
(2), (4) Date: Feb. 16, 2006

(87) PCT Pub. No.: WO2005/112868

PCT Pub. Date: Dec. 1, 2005

(65) Prior Publication Data

US 2008/0168750 A1 Jul. 17, 2008

(30) Foreign Application Priority Data

May 18, 2004 (IT) ..... BO2004A0310

(51) Int. Cl.
*B65B 47/00* (2006.01)

(52) U.S. Cl. ..... 53/560; 53/253; 53/281; 53/471

(58) Field of Classification Search ..... 53/253, 53/281, 282, 284, 560, 900, 471
See application file for complete search history.

(56) References Cited

U.S. PATENT DOCUMENTS 6,327,835 B1 * 12/2001 Trebbi ..... 53/53
6,425,422 B1 * 7/2002 Trebbi ..... 141/67
6,834,475 B2 * 12/2004 Trebbi et al. ..... 53/253
6,837,280 B2 * 1/2005 Ragazzini et al. ..... 141/83
6,866,493 B2 * 3/2005 Trebbi et al. ..... 425/107

(Continued)

FOREIGN PATENT DOCUMENTS

DE 43 36 233 A1 4/1995

(Continued)

*Primary Examiner*—Sameh H. Tawfik
(74) *Attorney, Agent, or Firm*—Arent Fox LLP

(57) ABSTRACT

A capsule filling machine (100) for the production of hard gelatin capsules (C) of the type with lid (3) and body (2) containing a quantity (1) of pharmaceutical material comprises a rotary turret or carousel (15) which defines at least one capsule (C) handling line (L) and on which the following are positioned, one after the other: at least one station (6) for feeding empty capsules (C); at least one opening station (20) where the capsule bodies (2) are separated from the lids (3) to form two separate rows of capsule bodies (2) and lids (3); at least one station (7) for feeding and dosing the quantities (1) of pharmaceutical material to be filled into the capsule bodies (2); and at least one station (8) for closing the capsules (C) by placing a lid (3) over each respective body (2); the machine (100) also comprises means (9) for detecting and volumetrically checking the quantity (1) of pharmaceutical material filled into each capsule body (2), the detecting and checking means (9) comprise transducer means (5) for measuring the volume of said quantities (1) before they are filled into the capsule bodies (2).

5 Claims, 3 Drawing Sheets

U.S. PATENT DOCUMENTS 7,153,118 B2 * 12/2006 Trebbi et al. ..... 425/107
2001/0035431 A1 11/2001 Runft
2003/0054063 A1 * 3/2003 Trebbi et al. ..... 425/261
2004/0172925 A1 * 9/2004 Ragazzini et al. ..... 53/560
2008/0141621 A1 * 6/2008 Funaro et al. ..... 53/138.1

FOREIGN PATENT DOCUMENTS

WO WO 00/32474 A1 6/2000

* cited by examiner

CAPSULE FILLING MACHINE AND METHOD FOR PRODUCING HARD GELATIN CAPSULES

CROSS-REFERENCE TO RELATED APPLICATION

This application is a National Stage entry of International Application Number PCT/IB2005/001398, filed May 9, 2005. The disclosure of the prior application is hereby incorporated herein in its entirety by reference.

TECHNICAL FIELD

The present invention relates to a capsule filling machine and method for producing hard gelatin capsules.

In particular, the present invention can be advantageously applied to the production of hard gelatin capsules of the type with lid and body which contain pharmaceutical material in solid form, such as pellets, microtablets and the like, which the present specification expressly refers to but without thereby restricting the scope of the invention.

BACKGROUND ART

A modern capsule filling machine for making hard gelatin capsules normally comprises a rotary turret or carousel equipped with a plurality of operating stations for processing the capsules according to a standard method consisting of the following sequence of basic steps: opening the closed empty capsules at a station where the capsule bodies are separated from the lids to form two separate rows of bodies and lids; filling a predetermined quantity of pharmaceutical material in solid form into each capsule body at a dosing station; and closing each filled capsule by applying a lid to the respective body.

Once closed, the capsules are expelled from the carousel of the filling machine and fed into an appropriate container.

The capsules made in filling machines of this type also have to be weighed to ensure that they have been filled correctly. At present, this is done according to two different methods.

In a first method, the final weight of the capsules is checked statistically, that is to say, by taking samples of closed filled capsules and weighing them on electronic checkweighers connected to the central unit that controls and sets the quantities of solid pharmaceutical material to be filled into the capsule bodies.

Although this method is effective, it has an inherent disadvantage linked precisely to the statistical nature of the checkweighing system. Thus, if sample capsules failing outside the predetermined weight ranges are detected, a certain amount of time passes before the system corrects the dose of pharmaceutical material. This "time lag" means there is always the risk that a certain number of unchecked capsules of incorrect weight will be produced.

In an alternative method, the level of the pharmaceutical material dose filled into each capsule body is individually checked before the lids are applied to the respective bodies.

The pharmaceutical material level, from which the weight of each capsule is calculated, is checked using optical sensors.

These optical sensors, however, are difficult to control, involve complicated calibrating procedures and, above all, are not always capable of providing satisfactory readings of the level of solid material in the capsule bodies, with the result that many capsules passed by the sensors are in fact incorrectly filled, that is to say, are subsequently found to be faulty in weight.

The present invention therefore has for an aim to overcome the above mentioned disadvantages.

In particular, the present invention has for an aim to provide a capsule filling machine where the weight of all the capsules is checked in the filling process during a rapid, accurate operating step performed using a simple and effective instrument of mechanical type.

DISCLOSURE OF THE INVENTION

This invention accordingly provides a capsule filling machine for the production of hard gelatin capsules of the type with lid and body containing a quantity of pharmaceutical material, the machine comprising a rotary turret or carousel which defines at least one capsule handling line and on which the following are positioned, one after the other: at least one station for feeding empty capsules; at least one opening station where the capsule bodies are separated from the lids to form two separate rows of capsule bodies and lids; at least one station for feeding and dosing the quantities of pharmaceutical material to be filled into the capsule bodies; and at least one station for closing the capsules by placing a lid over each respective body; the machine being characterised in that it further comprises means for detecting and volumetrically checking the quantity of pharmaceutical material filled into each capsule body, said detecting and checking means comprising transducer means for measuring the volume of said quantities before they are inserted into the capsule bodies.

This invention also relates to a method for producing hard gelatin capsules of the type with lid and body containing a quantity of pharmaceutical material, the method comprising the steps of feeding closed empty capsules to an opening station where the capsule bodies are separated from the lids to form two separate rows of capsule bodies and lids; filling each capsule body with a predetermined quantity of pharmaceutical material; and closing the filled capsule bodies by placing the lids over the respective bodies; the method being characterised in that it further comprises a step of detecting and volumetrically checking the quantity of pharmaceutical material, this step being performed before each quantity of pharmaceutical material is inserted into the respective capsule body.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DETAILED DESCRIPTION OF THE PREFERRED EMBODIMENTS OF THE INVENTION

Figure 1:
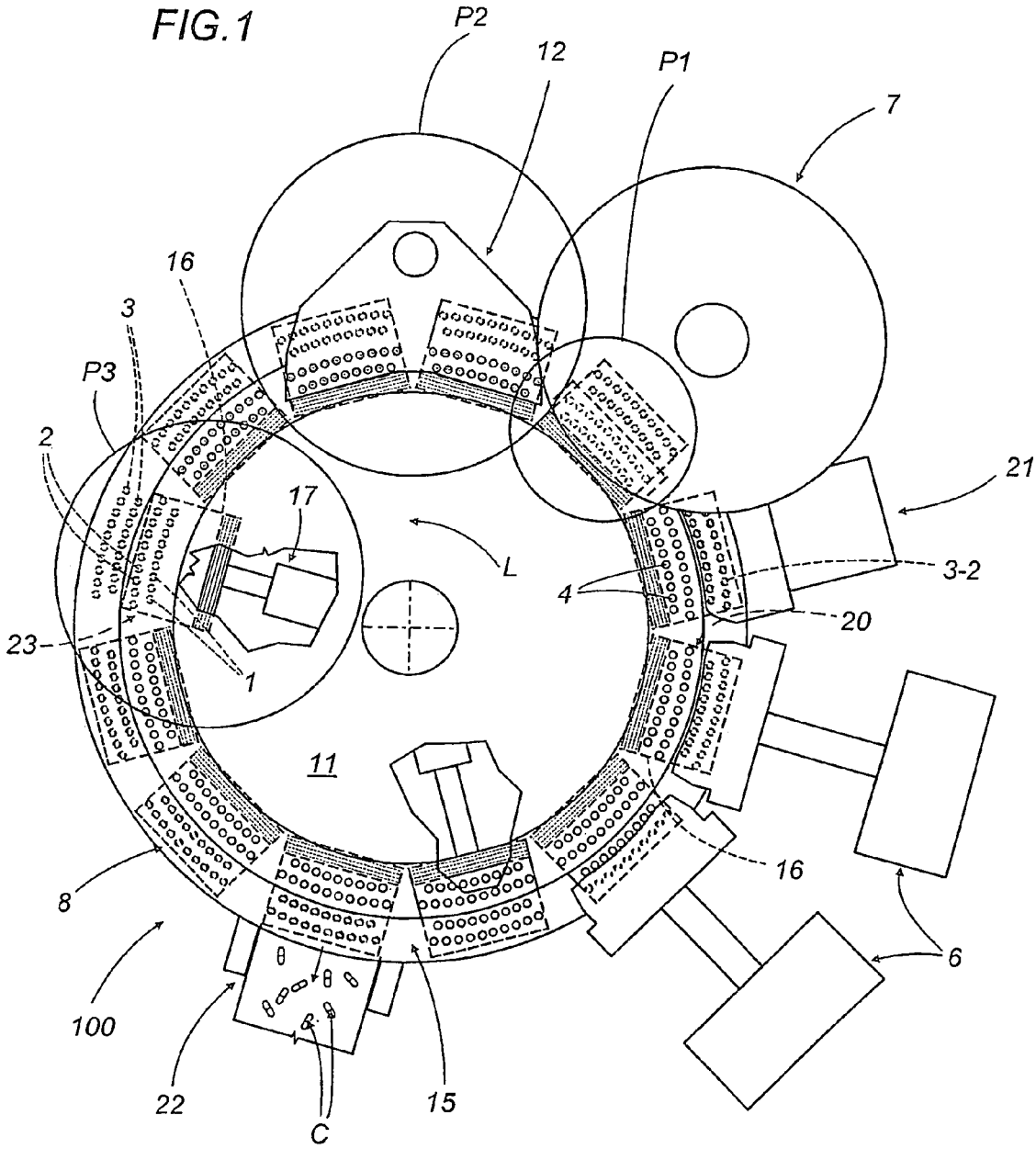
FIG. 1 is a schematic top plan view, with some parts in cross section and others cut away for clarity, of a capsule filling machine according to the present invention, for making hard gelatin capsules.

With reference to the accompanying drawings, the numeral 100 in FIG. 1 denotes in its entirety a capsule filling machine for making capsules C filled with pharmaceutical material in solid form, preferably microtablets or pellets.

Figure 2:
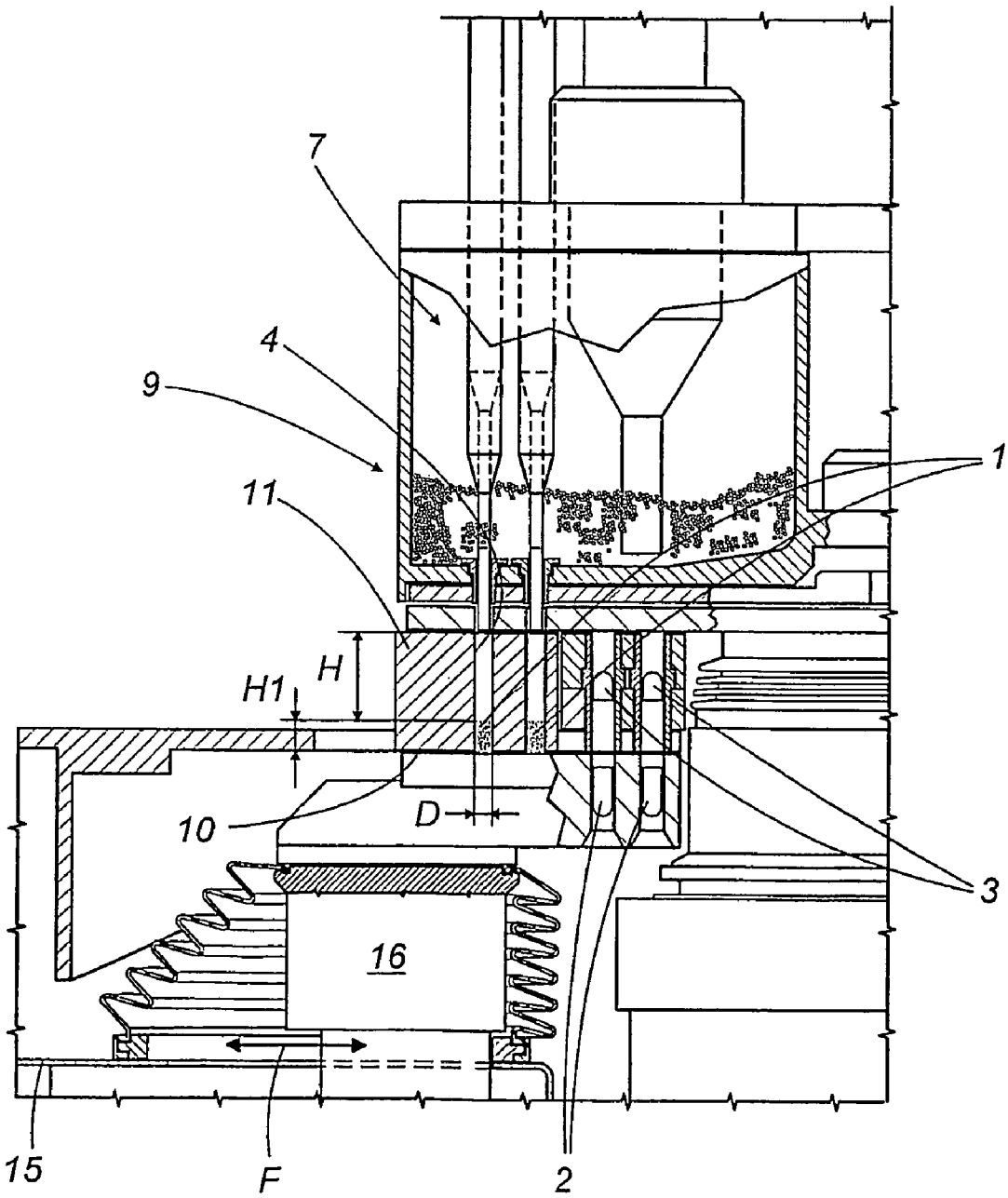
FIG. 2 is a schematic front view, with some parts in cross section, of a first detail P1 of the machine of FIG. 1, showing an operating station that doses the solid pharmaceutical material.
Figure 3:
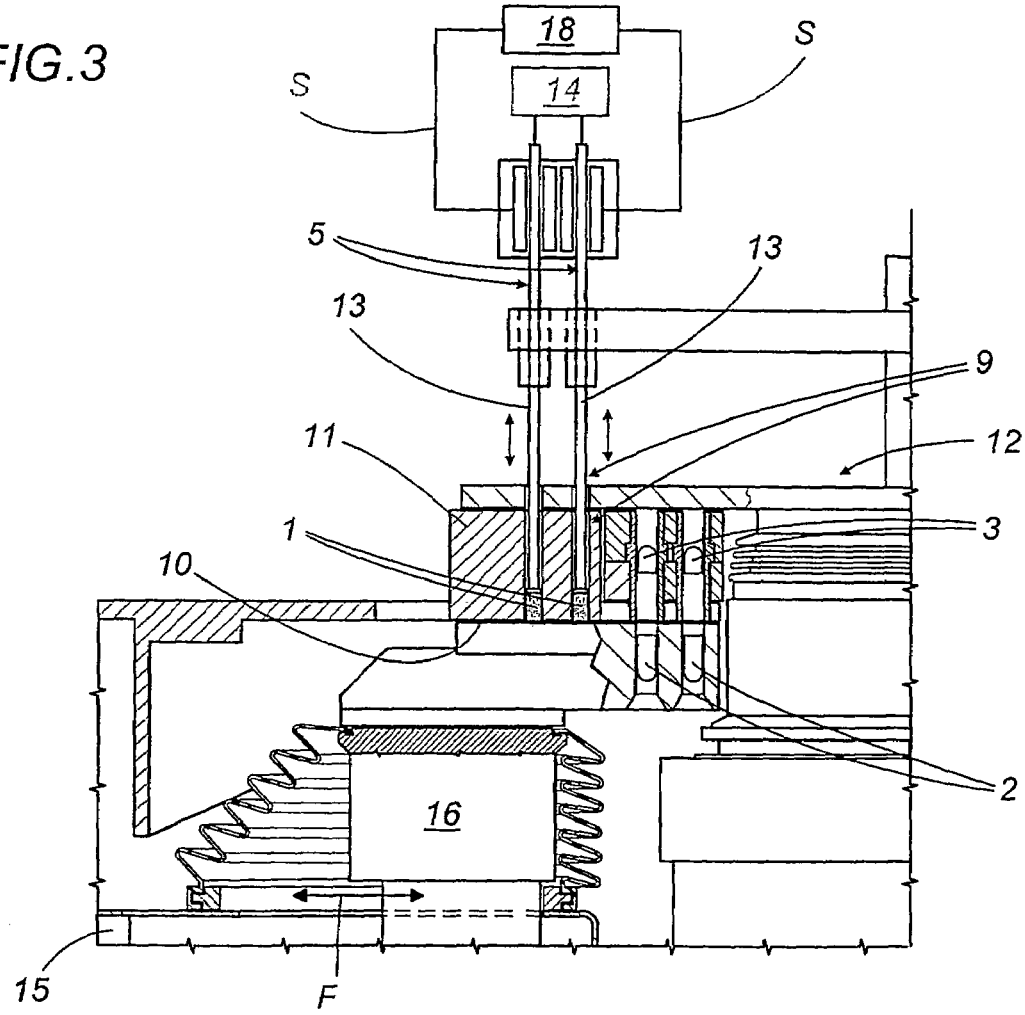
FIG. 3 is a schematic front view, with some parts in cross section, of a second detail P2 of the capsule filling machine of FIG. 1, showing a second operating station forming part of the machine.
Figure 4:
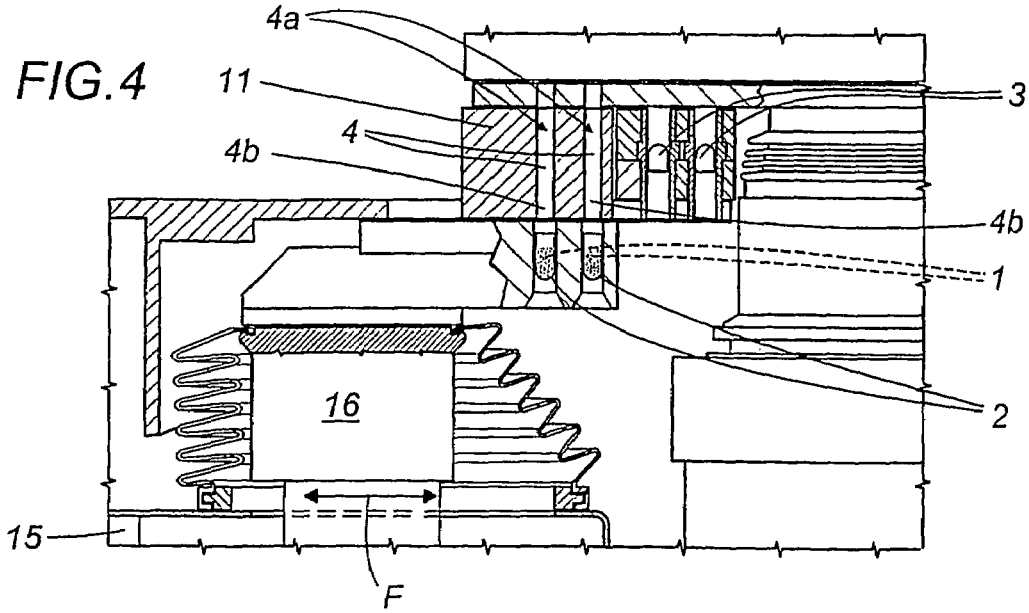
FIG. 4 is a schematic front view, with some parts in cross section, of a third detail P3 of the capsule filling machine of FIG. 1, showing a third operating station forming part of the machine according to the present invention.

The capsules C are of the known type with lid and body, that is to say, each comprises a body 2 for receiving the pharmaceutical material and a lid 3 which is placed over the body 2 in such a way as to close it (FIGS. 2, 3 and 4).

As illustrated in FIG. 1, the capsule filling machine 100 is of the type comprising a rotary turret or carousel 15 which defines at least one circular line L for handling the capsules C and which is equipped with a plurality of operating stations for processing the capsules C themselves. Preferably, as shown in the accompanying drawings, the machine 100 has two adjacent and identical capsule C handling lines L but for brevity of description reference will be made to only one handling line L.

More specifically, the aforementioned operating stations comprise: at least one station 6 for feeding the capsule bodies 2 and lids 3 in a closed, empty configuration, that is to say, joined to each other but empty; an opening station 20 where the capsule bodies 2 are separated from the lids 3 to form two separate rows of capsule lids 3 and bodies 2; a station 7 for feeding and dosing the pharmaceutical material to be filled into the capsule bodies 2; a station 8 for closing the capsules C by placing a lid 3 over each respective body 2; and, lastly, an outfeed station 22 for unloading the capsules C made in this way into a container (of known type and not illustrated).

As shown in FIGS. 2, 3 and 4, the machine 100 also comprises, at the dosing station 7, means 9 for detecting and volumetrically checking the quantity 1 of pharmaceutical material to be filled into each capsule body 2.

The checking means 9 comprise at least one uniformly distributed series of compartments or chambers 4 for holding respective quantities 1 of pharmaceutical material (FIGS. 2 and 4 show identical and adjacent series of chambers 4).

As illustrated in FIGS. 2 and 4, the chambers 4 are made in a dose checking disk 11 associated with the carousel 15 that rotates along the aforementioned circular line L. Each chamber 4 is cylindrical in shape, with a height H and a uniform diameter D, and has an opening 4*a* at the top and an opening 4*b* at the bottom, the latter being designed to be closed by suitable contact elements 10 of the reciprocating plate type moving towards and away from the chamber 4 itself (arrow F, FIGS. 3 and 4).

Again with reference FIGS. 2, 3 and 4, each chamber 4 houses a linear transducer element 5 (FIG. 3) (also known by the term Linear Variable Detector Transducer or LVDT) which forms an integral part of the checking means 9.

The linear transducer 5 is designed to detect the height H1 of the quantity 1 of pharmaceutical material inside the chamber 4 (FIG. 2) at a checking station 12 of the machine 100.

At a constructional level, the checking station 12 is located between the dosing station 7 and the closing station 8 on the handling line L and is equipped with the linear transducers 5, each of which comprises a sliding detector element 13 driven vertically by actuating means 14 (illustrated as a block since they are of well known type) and designed to measure the height H1 reached by the quantity 1 of pharmaceutical material in the respective dosing chamber 4 (FIG. 3).

Each linear transducer 5 is in turn connected to a control and processing unit 18 designed to receive from the linear transducer 5 itself a signal S proportional to the H1 of the material detected in the respective chamber 4. During use, the control unit 18 (also illustrated as a block in FIG. 3) processes the signal S received and, through a predetermined algorithm, compares the signal S with a reference signal characteristic of a required range within which the quantity 1 of material to be filled into the capsule body 2 must lie, using known parameters such as, in particular, the size of the chamber 4. In the event of deviation from this range, the control unit 18 applies corrective output signals to the feeding and dosing station 7.

By checking the correctness of the predetermined quantity of pharmaceutical material to be filled into each capsule body 2, the linear transducer 5 checks the correctness of the weight of each capsule C made by the machine 100.

As shown in FIG. 1, the carousel 15 is divided into a plurality of slides 16 for supporting the capsule bodies 2, each slide 16 being positioned under the dose checking disc 11 and being synchronised with the disc 11 itself.

The slides 16 have an upper horizontal surface 10 constituting the aforementioned contact elements 10, that is to say, the plate that closes the bottoms of the dosing chambers 4.

Further, each slide 16 is driven by radial drive means 17 between a first, idle position in which the capsule bodies 2 are away from the chambers 4 of the plate 10 (see FIGS. 2 and 3), and a second, working position in which each capsule body 2 is positioned coaxially under a respective dosing chamber 4 in such a way that the quantity 1 of pharmaceutical material can be transferred from the chamber 4 to the respective capsule body 2 during the horizontal movement of the slide 16 in direction F (FIG. 4).

This step of actually transferring the quantity 1 into the capsule body 2 is performed at a station 23 of the machine 100 located on the handling line L upstream of the capsule C closing station 8.

The capsule filling machine 100 made in this way achieves the aforementioned aims thanks to the presence of the dose checking disc 11 which comprises the chambers 4 in which the linear transducers 5 operate: this permits a rapid and precise volumetric check to be carried out on the quantity of pharmaceutical material before such quantity is actually placed in each capsule body 2. In other terms, the weight of each capsule C is checked by a simple and effective linear transducer in real time during the process in which the solid pharmaceutical material is actually filled into the capsules C, before the latter are closed.

It will be understood that the invention can be modified and adapted in several ways without thereby departing from the scope of the inventive concept. Moreover, all the details of the invention may be substituted by technically equivalent elements.

The invention claimed is:

1. A capsule filling machine for producing hard gelatin capsules of a type with lid and body containing a quantity of pharmaceutical material, the machine comprising a rotary turret or carousel which defines at least one capsule handling line and on which the following are positioned, one after the other: at least one station for feeding empty capsules; at least one opening station where capsule bodies are separated from lids to form two separate rows of capsule bodies and lids; at least one station for feeding and dosing the quantities of pharmaceutical material to be filled into the capsule bodies; and at least one station for closing the capsules by placing a lid over each respective body; wherein the machine further comprises volume transducer element configured to generate a signal representative of a height of the pharmaceutical material placed in a dosing chamber, said signal being elaborated by a control and processing unit configured to calculate a volume of the quantity of pharmaceutical material into the dosing chamber and to be inserted into the capsule bodies.

2. The machine according to claim 1, wherein the volume transducer element comprises elements for detecting the quantities of pharmaceutical material.

3. A capsule filling machine according to claim 1 wherein the transducer element comprises a sliding detector element driven vertically and designed to enter the dosing chamber associated with the carousel and designed to measure the height reached by the quantity of pharmaceutical material in the respective dosing chamber.

4. A capsule filling machine according to claim 1, comprising a dose checking disc coupled with the carousel; the disc having made in it at least one series of dosing chambers of predetermined size, inside each of which the quantity of pharmaceutical material is temporarily placed; the volume transducer element being designed to operate in the chambers.

5. The machine according to claim 4, wherein each chamber is designed to be closed at the bottom by reciprocating contact elements moving towards and away from the carousel.

* * * * *